US006957992B2

(12) United States Patent
Iosue

(10) Patent No.: US 6,957,992 B2
(45) Date of Patent: Oct. 25, 2005

(54) IMAGE INTENSIFICATION TUBE

(75) Inventor: Michael Jude Iosue, Phoenix, AZ (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 11/004,241

(22) Filed: Dec. 3, 2004

(65) Prior Publication Data

US 2005/0106983 A1 May 19, 2005

Related U.S. Application Data

(62) Division of application No. 10/765,538, filed on Jan. 27, 2004, which is a division of application No. 09/962,660, filed on Sep. 25, 2001, now Pat. No. 6,465,938, which is a division of application No. 09/272,039, filed on Mar. 18, 1999, now Pat. No. 6,331,753.

(51) Int. Cl.[7] ..... H01J 31/50
(52) U.S. Cl. ..... 445/24; 250/214 VT
(58) Field of Search ..... 445/24, 25; 313/542, 313/103 R, 532, 103 CM, 105 CM, 105 R, 528; 250/207, 208, 214 VT, 330

(56) References Cited

U.S. PATENT DOCUMENTS 4,295,073 A * 10/1981 Freeman et al. ..... 313/105 CM
5,369,267 A * 11/1994 Johnson et al. ..... 250/214 VT
5,404,072 A * 4/1995 Flanary et al. ..... 313/477 R
5,510,673 A * 4/1996 Wodecki et al. ..... 313/524
5,633,493 A * 5/1997 Suzuki et al. ..... 250/214 VT
5,883,380 A * 3/1999 Sinor ..... 250/214 VT
5,994,824 A * 11/1999 Thomas et al. ..... 313/105 CM
6,331,753 B1 * 12/2001 Iosue ..... 313/542
6,465,938 B2 * 10/2002 Iosue ..... 313/103 CM
6,483,231 B1 * 11/2002 Iosue ..... 313/103 CM
6,724,131 B2 * 4/2004 Iosue ..... 313/103 CM
6,847,027 B2 * 1/2005 Iosue ..... 250/214 VT

* cited by examiner

*Primary Examiner*—Joseph Williams
*Assistant Examiner*—Dalei Dong
(74) *Attorney, Agent, or Firm*—Marsteller & Associates, P.C.

(57) ABSTRACT

An image intensifier tube includes a photocathode (20) with an active layer (52) providing an electrical spectral response to photons of light. The photocathode (20) also includes integral spacer structure (42) which extends toward and physically touches a microchannel plate (22) of the image intensifier tube in order to establish and maintain a desirably precise and fine-dimension spacing distance "G" between the photocathode and the microchannel plate. A method of making the photocathode and a method of making the image intensifier tube are described also.

11 Claims, 4 Drawing Sheets

IMAGE INTENSIFICATION TUBE

BACKGROUND OF THE INVENTION

1. Field of the Invention

The present invention is in the field of night vision devices. More particularly, the present invention relates to an image intensifier tube usable in such night vision devices. Such image intensifier tubes are generally responsive to infrared radiation to provide an image in visible light which is replicative of a scene which may be too dim to be viewed with the unaided natural human vision. Still more particularly, the present invention relates to a photocathode for use in such an image intensifier tube, which photocathode according to the preferred embodiment includes integral structure for establishing and maintaining a precise fine-dimension spacing between the photocathode and a microchannel plate of the image intensifier tube. In other words, in the preferred embodiment, part of the photocathode extends to and physically touches the microchannel plate to establish a minimal spacing dimension between the photocathode and the microchannel plate. Further, the present invention relates to a method of making such a photocathode and an image intensifier tube including such a photocathode.

2. Related Technology

Image intensifier tubes which are responsive to low-level visible or infrared light are commonly used in night vision systems. Night vision systems are used by military and law enforcement personnel for conducting operations in low light conditions, or at night. Further, such night vision devices find many civilian uses for hunting, conservation, industrial observations in low-light conditions, and many other uses. For example, night vision systems are used by pilots of helicopters and airplanes to assist their ability to fly at night.

A night vision system converts the available low-intensity ambient light of the visible spectrum, and also at the near infrared portion of the invisible infrared spectrum to a visible image. These systems require some minimal level of ambient light, such as moon light or star light, in which to operate. This minimal level of ambient light may be infrared light which does not provide visibility to the natural human vision. The ambient light is intensified by the night vision system to produce an output image which is visible to the human eye. The present generation of night vision systems utilize image intensification technologies to intensify the low-level visible light as well as the near-infrared invisible light. This image intensification process involves conversation of the received ambient light into electron patterns, intensification of the electron patterns while retaining the relative intensity levels and contrast of the scene, and projection of the electron patterns onto a phosphor screen for conversion into a visible-light image for the operator. The visible-light image is then viewed by an operator of the night vision system through a lens provided in an eyepiece of the system.

The typical night vision system has an optics portion and a control portion. The optics portion comprises lenses for focusing on a scene to be viewed, and an image intensifier tube. The image intensifier tube performs the image intensification process described above, and includes a photocathode liberating photo-electrons in response to light photons to convert the light energy received from the scene into electron patterns, a micro channel plate to multiply the electrons, a phosphor screen to convert the electron patterns into visible light, and possibly a fiber optic transfer window to invert the image. The control portion includes the electronic circuitry necessary for controlling and powering the image intensifier tube portion of the night vision system.

A factor limiting the performance of conventional image intensification tubes is the photocathode, and its spacing from the microchannel plate. That is, the photocathode of conventional image intensifier tubes is spaced sufficiently from the microchannel plate that a phenomenon known as halo occurs, and such that a higher than desired voltage must be maintained between the photocathode and the microchannel plate.

On the other hand, manufacturing economies, limitations, and practices have heretofore frustrated attempts to reduce the spacing dimension between a photocathode and the microchannel plate of an image intensifier tube. To place this problem in perspective, conventional spacing dimensions for GEN III image intensifier tubes are on the order of 250 $\mu$m (+ or − about 25 $\mu$m). This dimension is 0.000250 meter. Understandably, manufacturing tolerances and practices must be very precise to position a photocathode and microchannel plate at this distance from one another, parallel to one another—within tolerances, and without having these two structures touch one another. Further, the electric field which exists between these two structures is strongly affected by the spacing dimension between them.

If the spacing is too small in conventional image intensifier tubes, then electrical discharge areas can occur—rendering the tube unusable. Similarly, too great of a spacing dimension results in a tube of sub-par performance.

A conventional photocathode for an infra-red type of sensor is known in accord with U.S. Pat. No. 3,959,045, issued 25 May 1976, to G. A. Antypas. The photocathode taught by the '045 patent is one version of the now-conventional Gen 3 photocathode described above.

However, the conventional spacing dimension used in conventional image intensifier tubes is much greater than desired. In order to allow the image intensifier tube to operate with a lower level of voltage applied between the photocathode and the microchannel plate, it is desirable to reduce the spacing between the photocathode and the microchannel plate, perhaps by as much as an order of magnitude below that spacing that is presently conventional. Such a reduction in spacing dimension between the photocathode and microchannel plate would, it is believed, also be effective to reduce or eliminate the halo phenomenon.

SUMMARY OF THE INVENTION

In view of the above, a need exists to provide an image intensifier tube ($I^2T$) which has a spacing dimension between the photocathode (PC) and microchannel plate (MCP) of the tube which is substantially smaller than conventional.

Further to the above, it is desirable and is an object for this invention to provide a photocathode for an image intensifier tube which includes integral spacer structure, for extending toward and physically touching the microchannel plate of the image intensifier tube, so as to precisely space this microchannel plate away from the photocathode.

Additionally, a need exists for a method of making such a photocathode, and for making an image intensifier tube including such a photocathode.

Accordingly the present invention provides according to a particularly preferred exemplary embodiment of the invention, apparatus including a paired photocathode and microchannel plate, the photocathode responding to photons of light by releasing photoelectrons, and the microchannel plate receiving the photoelectrons and responsively releasing secondary-emission electrons, the photocathode/microchannel plate pair comprising: a photocathode active layer defining an active area responsive to photons of light to liberate photoelectrons, and an insulative spacing structure circumscribing the active area and extending between the photocathode at the active area and the microchannel plate, the spacing structure having an end surface confronting and physically contacting one of the photocathode and microchannel plate to establish a minimum spacing distance between the active area and the microchannel plate.

Also, the present invention provides a method of making such a photocathode, and an image intensifier tube including such a photocathode.

In view of the above, it will be apparent that an advantage of the present invention resides in the provision of a photocathode with integral PC-to-MCP spacer structure. Further, this spacer structure of the PC actually extends toward and physically touches the MCP to establish the spacing between these two structures. It follows that physically tolerances of the body of an $I^2T$ embodying the present invention have a much lesser or no significant effect upon the PC-to-MCP spacing.

These and additional objects and advantages of the present invention will be apparent from a reading of the present detailed description of a single particularly preferred exemplary embodiment of the present invention, taken in conjunction with the appended drawing Figures, in which the same reference numeral refers to the same feature, or to features which are analogous in structure or function to one another.

DESCRIPTION OF THE DRAWING FIGURES

FIG. 1 provides a schematic depiction of an night vision device including an image intensifier tube ($I^2T$);

Figure 3:
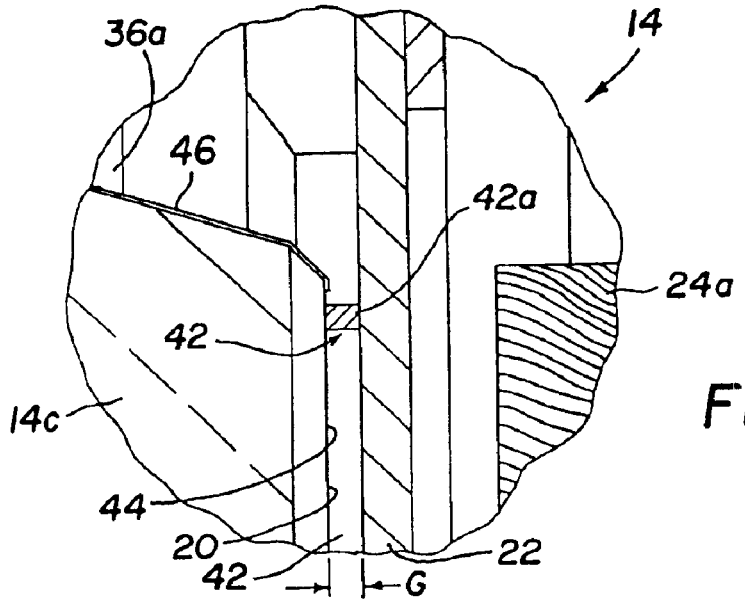
FIG. 3 is a greatly enlarged view of an encircled portion of FIG. 2.
Figure 4:
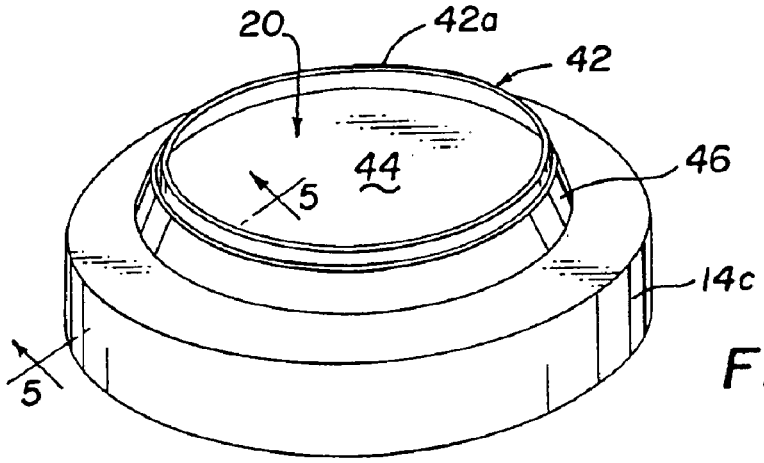
Figure 5:
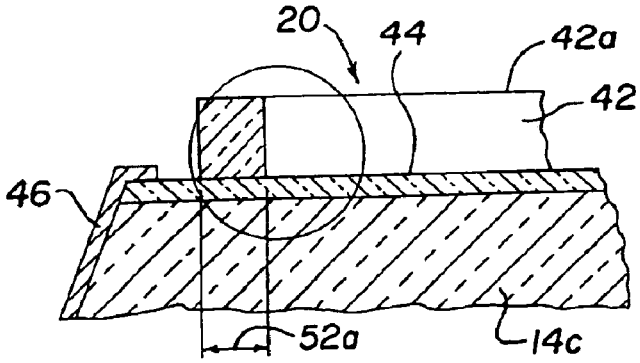
Figure 6:
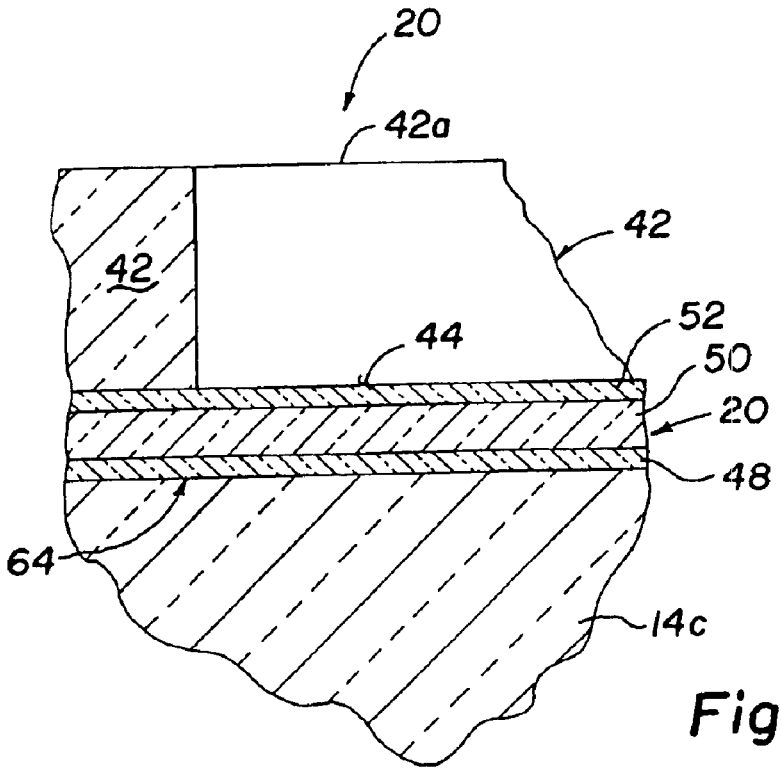
Figure 7:
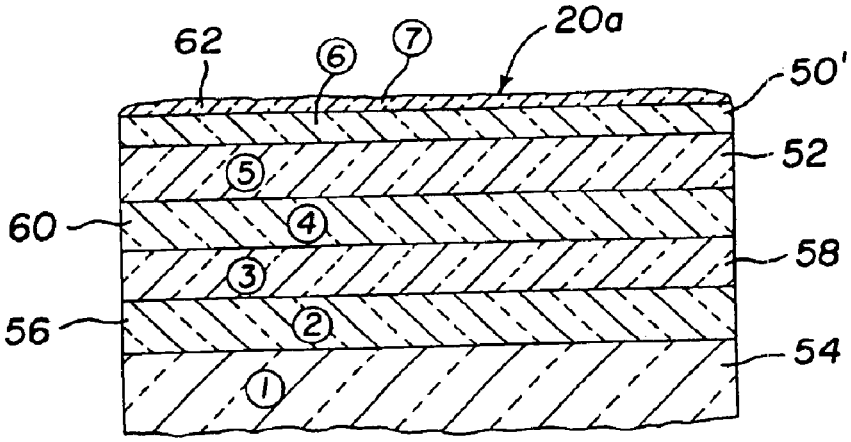
Figure 8:
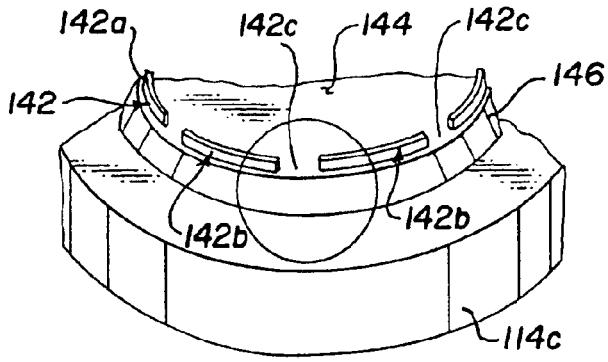
Figure 9:
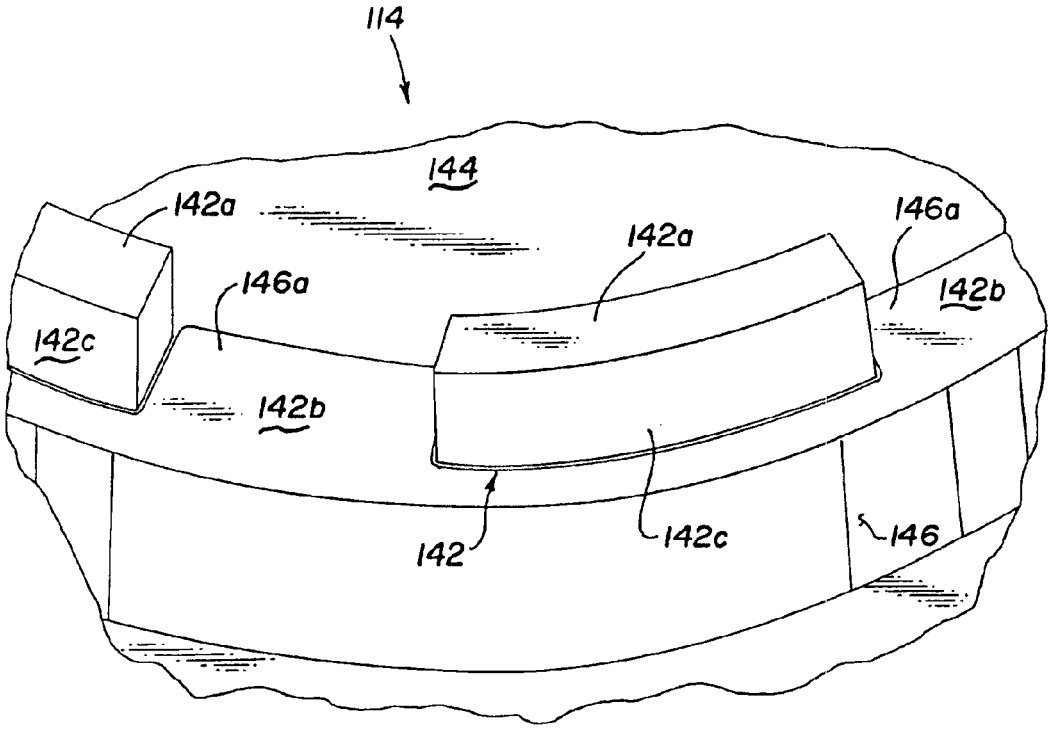

FIG. 4 presents a perspective view of a window member for an image intensifier tube according to the present invention, which window member includes an inventive photocathode;

FIG. 5 is a greatly enlarged fragmentary cross sectional taken at line 5—5 of FIG. 4;

FIG. 6 is a still more greatly enlarged view of an encircled portion of FIG. 5;

FIG. 7 schematically presents a photocathode workpiece at a selected stage of manufacture;

FIG. 8 is a perspective view similar to FIG. 3, but showing an alternative embodiment of a photocathode according to the present invention; and FIG. 9 is a greatly enlarged fragmentary perspective view of the photocathode seen in FIG. 8.

DETAILED DESCRIPTION OF THE PREFERRED EXEMPLARY EMBODIMENTS OF THE INVENTION

While the present invention may be embodied in many different forms, disclosed herein are two specific exemplary embodiments which each individually as well as together illustrate and explain the principles of the invention. It should be emphasized that the present invention is not limited to the specific embodiments illustrated and described.

Figure 1:
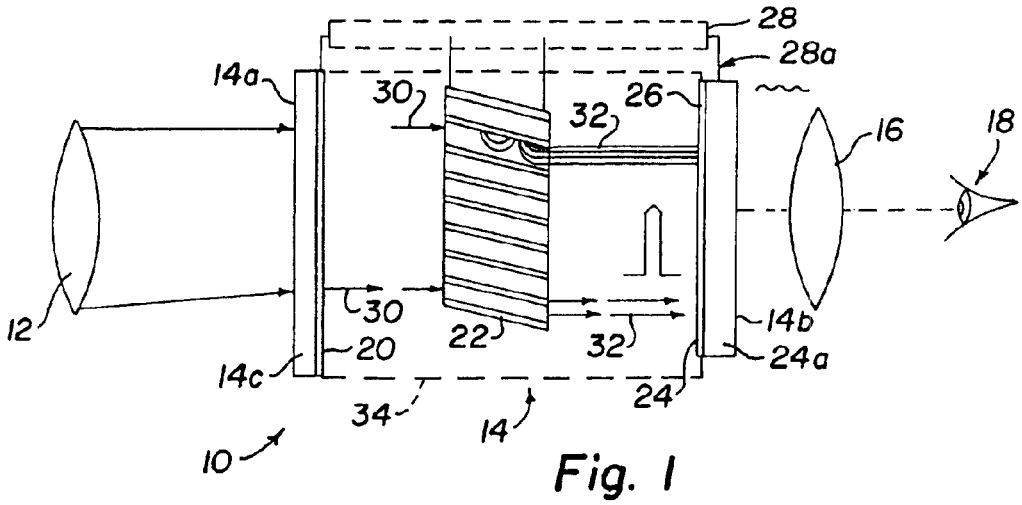

Referring first to FIG. 1, there is shown schematically the basic elements of one version of a night vision device 10 of the light amplification type. Night vision device 10 generally comprises a forward objective optical lens assembly 12 (illustrated schematically as a single lens element, although it will be understood that the objective lens assembly 12 may include one or more lenses. This objective lens 12 focuses incoming light from a distant scene (which may be a night-time scene illuminated with only star light or with infrared light from another source) through the front light-receiving end surface 14*a* of an image intensifier tube ($I^2T$) 14. As will be seen, this surface 14*a* is defined by a transparent window portion 14*c* of the tube—to be further described below.

As was generally explained above, the $I^2T$ provides an image at light output end 14*b* in phosphorescent yellow-green visible light, which image replicates the scene. The visible image from the $I^2T$ is presented by the device 10 to a user via an eye piece lens illustrated schematically as a single lens 16 producing a virtual image of the rear light-output end of the tube 14 at the user's eye 18. More particularly now viewing the $I^2T$ 14, it is seen that this tube includes: a photocathode (PC) 20 which is carried upon an inner surface of the window portion 14*c*, and which is responsive to photons of visible light and of invisible infrared light to liberate photoelectrons; a microchannel plate (MCP) 22 which receives the photoelectrons in a pattern replicating the (and which provides an amplified pattern of electrons also replicating this scene); and a display electrode assembly 24. In the present embodiment the display electrode assembly 24 may be considered as having an aluminized phosphor coating or phosphor screen 26. When this phosphor coating is impacted by the electron shower from microchannel plate 22, it produces a visible image replicating the pattern of the electron shower. Because the electron shower in pattern intensity still replicates the scene viewed via lens 12, a user of the device can effectively see in the dark, viewing a scene illuminated by, for example, only star light or other low-level or invisible infrared light.

Figure 2:
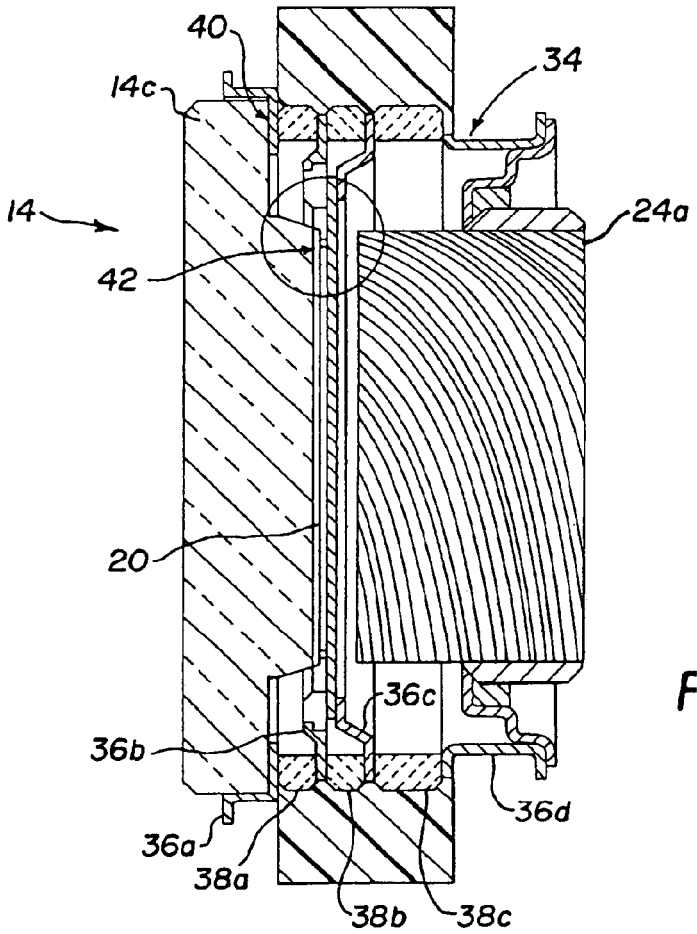
FIG. 2 is a longitudinal cross section of an image intensifier tube, with an associated power supply, and includes schematically depicted optical elements for a night vision device.

A transparent image output window portion 24*a* of the assembly 24, to be further described below, defines the surface 14*b* and conveys the image from screen 26 outwardly of the tube 14 so that it can be presented to the user 18. The image output window portion 24*a* may be plain glass, or may be fiber optic, as depicted in FIG. 2. Those ordinarily skilled will understand that a fiber optic output window 24*a* may include a 180° twist of the fibers over the length of this window portion, so that it inverts the image provided by the screen 26.

The tube 20 is powered by a conventional image tube power supply 28, connected to the tube 20 by plural power supply conductors 28*a*. Those ordinarily skilled in the pertinent arts will understand that the power supply 28 maintains a electrostatic voltage gradient in the ($I^2T$) 14, and provides a current flow which is necessary to provide a shower of electrons in a pattern which replicates the image of the viewed scene. As is seen in FIG. 1, and as will be further explained, the power supply 28 provides via connections 28*a*, a voltage and current supply connection to the PC 20, to opposite facial electrodes of the MCP 22, and to the display assembly 24.

Light which is received through the window portion 14*c* is incident upon the photocathode portion 20 of the image intensification tube 14. The photocathode 20 in one respect which is conventional, is responsive to incident photons of particular frequencies and wavelengths to emit photoelectrons in response to the photons, as is indicated by the arrows 30. The photoelectrons 30 move rightwardly, viewing FIG. 1, under the influence of the prevailing electrostatic field from power supply 28 and into the various microchannels of the microchannel plate 22. This microchannel plate 22 is specially constructed to provide secondary emission electrons in response to the photoelectrons 30. As is indicated by the arrowed reference numeral 32 and the associated lead line, at the outlet side of the MCP 22, a shower of photoelectrons and secondary emission electrons is provided by the microchannel plate 22. The pattern of the shower 32 of electrons replicates the pattern of the photons falling on the photocathode 20. This shower of electrons 32 is directed to the phosphorescent screen 26 where it produces a visible image replicative of the image falling on the photocathode 20, but more intense by several orders of magnitude.

It will be noted further viewing FIG. 1, that the tube 14 includes a generally tubular housing, which is indicated generally by the numeral 34. This housing 34 is sealingly closed at one end by the window portion 14*c* and at the other end is closed by the image output window 24*a*. Between the window portions 14*c* and 24*a*, the housing 34 includes a plurality of metallic ring elements, indicated with the reference numeral 36, having alphabetic suffixes added thereto in order to distinguish the individual metallic rings from one another. Disposed between the metallic ring elements 36, is a plurality of insulator ring elements, which in this case are preferably made of ceramic material, and which are indicated with the numeral 38 having an alphabetic suffix added thereto to distinguish the individual insulator rings.

At the interface of metallic ring element 36*a* and window portion 14*c*, is disposed a variable-dimension, selectively-deformable metallic seal element, indicated with the arrowed numeral 40. By "variable-dimension" in this instance is meant that the seal element 40 may have a variety of axial lengths along the length dimension of tube 14 between the window portions 14*c* and 24*a*. Because of this variable-dimension seal element, the spacing "G" defined between the PC 20 and the MCP 22 is potentially variable. However, as will be seen, according to the present invention the spacing "G" of the image tube 14 is precisely established and maintained at a fine-dimension value which is much smaller than was heretofore reliably obtainable in serial production of image intensifier tubes.

Turning now to FIGS. 3 and 4, which respectively provide a greatly enlarged fragmentary view of an encircled portion of FIG. 2, and a perspective view of the window portion 14*c* in isolation (but including the metallic ring element 36*a* and PC 20), it is seen that the PC 20 carried on window portion 14*c* includes a circumferentially extending fine-dimension insulative rib 42. This rib 42 in the $I^2T$ 14 extends axially toward and actually physically touches, the MCP 22. Preferably, the rib 42 is formed of Aluminum Gallium Arsenide (AlGaAs). As will be seen further, because of the insulative rib 42, during manufacturing of the $I^2T$ 14 at a time when the window portion 14*c* including PC 20 and metallic ring element 36*a* is sealingly united with the variable-dimension, selectively deformable seal element 40, this seal element is selectively deformed such that the rib 42 at an end surface 42*a* thereof, contacts the MCP 22. This contact of the rib 42 with the MCP 22 establishes and maintains a selected fine-dimension spacing distance "G" between an active area of the PC 20 and the MCP 22, as is explained below.

At this point in the explanation, it is well to note that within the rib 42, the PC 20 has an active area 44. The active area 44 defines the surface from which photoelectrons are liberated by the PC 20 in response to photons of light from the scene. In order to make electrical connection with the active area 44, the window portion 14*c* includes a thin metallic metallization layer 46 extending across a surface of the window portion 14*c* between metallic ring element 36*a* and the peripheral edge of the PC 20. Viewing FIG. 4, it is seen that the metallization layer 46 contacts a peripheral portion of material of the active area 44, but that this contact is outside of the rib 42. Further, the rib 42 is integral with but a different material from the material of the active area 44. The material of the active area 44 extends integrally under the rib 42 in order to make sufficient electrical contact with the metallization layer 46.

Turning to FIG. 6, it is seen that the PC 20 includes plural sub-layers, which are all carried upon the window portion 14*c*, and which are cooperative in achieving the objective for the PC 20 to release photoelectrons in response of photons of light from the scene, and also to establish the PC-to-MCP spacing at the interface of the PC 20 with the MCP 22. To this end, the PC 20 includes an anti-reflective layer 48, which interfaces directly with the window portion 14*c*. The anti-reflective layer 48 may be formed of Silicon dioxide, and Silicon nitride (i.e., $SiO_2$ and $Si_3N_4$). Upon the anti-reflective layer 48 is carried a window layer 50, which is principally formed of Aluminum Gallium Arsenide (AlGaAs) as will be more particularly explained below. The window layer 50 carries an active layer 52, which may be formed of Gallium Arsenide (GaAs). It is this active layer 52 which carries the rib 42 and defines the active area 44, as is seen in FIG. 5.

Particularly, it is to be noted that the active layer 52 extends between the metallization 46 (seen in FIG. 5, for example), and the active area 44. Thus, the electrical connection to the active area portion of layer 52 is effected by the ring 36*a*, which has connection to the metallization, 46, and from this metallization 46 to the outer circumferential portion of the layer 52 outwardly of rib 42. From the outer circumferential portion of layer 52 outwardly of rib 42, the electrical connection to the area 44 is effectively defined by that portion of the active layer 52 which is immediately under the rib 42. Thus in this embodiment, the conductivity of an annular circumferential portion of the layer 52, which immediately under the rib 42, and which is indicated on FIG. 5, by the dashed lines coincident with the inner and outer edges of this rib 42, and the reference numeral 52*a*, is relied upon to conduct the necessary electron current to the active area 44.

FIG. 6 provides a schematic illustration of a PC work piece (indicated with reference numeral 20*a*) which will become the PC 20, but which in FIG. 6 is shown at an unfinished intermediate stage of manufacture. Viewing FIG. 6, the work piece 20*a* includes a bulk substrate 54, which provides a foundation upon which the other layers of the PC 20 may be formed. The bulk substrate 54 is preferably formed of Gallium Arsenide (GaAs), and carries a buffer layer 56 of high quality single crystalline GaAs which has been formed by MOCVD technique. The bulk substrate 54 is preferably a low defect density single crystal wafer in the crystal orientation of (001). The buffer layer 56 effectively reduces or eliminates the propagation into subsequent layers of crystal-quality imperfections or degradations, which could result from crystalline defects in the GaAs substrate material 54. The buffer layer 56 also minimizes contamination (i.e., from the substrate 54) of the subsequent layers of material to be grown atop this substrate. Preferably, the buffer layer 56 is about 1.0 microns thick.

Atop the buffer layer 56 is placed a stop layer 58, which is about 0.5 microns thick, and which is preferably in the range of from about 50 to about 60 atomic percent aluminum in a stop layer of aluminum gallium arsenide (AlGaAs). As will be better understood in view of following explanation, the etch rate of this stop layer can be controlled by varying the proportion of aluminum in this layer.

On the stop layer 58 is placed a spacer layer 60, which is again formed of aluminum gallium arsenide (AlGaAs), with the atomic percentage of aluminum selected to allow this layer to be selectively patterned and etched, as is further explained below. The active layer 52 of GaAs, which is about a micron or more in thickness is formed atop the spacer layer 60. This active layer 52 is doped with a p-type of impurity, such as zinc, for example, to produce a negative electron affinity for the active layer 52. Preferably, the active layer 52 is doped at a concentration of about $1\times10^{19}$ dopant atoms per cubic centimeter of GaAs material in the active layer 52. This active layer 52, may be controlled in thickness, as is explained below, in order to be sufficiently thin as to maximize the yield of photoelectrons arriving at the lower surface of the active layer 52 (i.e., via the window portion 14*c*, which will be disposed there after completion of manufacturing). Dependent upon the spectral response desired for a particular photocathode, the thickness of the finished active layer 52 may be in the range of from about 1.2 microns or more to as little as about 0.2 micron to 0.7 micron. For a high sensitivity to blue-green light, for example, the active layer 52 would be between 0.4 and 0.5 micron thick. Most preferably if a high blue-green sensitivity is desired, then the active layer 52 is about 0.45 micron thick.

On the active layer 52 is formed the window layer 50 of AlGaAs, which is also of a thickness of less than or equal to about one micron. Preferably, this window layer 50 has a thickness of about 0.5 to about 0.7 micron. This window layer 50 is doped also with a p-type of impurity, preferably to a concentration of impurity atoms of about $1\times10^{18}$ dopant atoms per cubic centimeter of AlGaAs in the window layer 50, or lower.

In order to make the window layer 50 more transparent to light in the shorter wavelengths, such as light as short in wavelength as the blue-green transition, and blue light as well, if desired, the window layer 50 may be formed with a concentration of aluminum in the AlGaAs of at least eighty (80) percent. Preferably, if blue-green and blue light sensitivity is desired, then the window layer 50 of AlGaAs has a concentration of Al in the range of 83 to 90 atomic percent. Because of considerations having to do with preparation of a high quality interface with the active layer 52 and minimization of difficulties in the photocathode fabrication process, concentrations of aluminum in the window layer of greater than 90 percent are probably not advisable. Atop the window layer 50 a temporary top layer 62 of GaAs may be formed.

Consideration of FIG. 7 will show that the steps and structure so far described are depicted diagrammatically as the structural result of steps 1 through 7 (i.e., by the circled step number associated with each respective structural layer of the work piece structure seen in FIG. 7). If used, the temporary top layer 62 is subsequently etched away using a suitable concentration of a conventional etchant, such as $NH_4OH$ and $H_2O_2$, A thin anti-reflective layer 48 of $SiO_2$ and $Si_3N_4$ is deposited on the window layer 50. A thin passivating layer (indicated by arrowed numeral 64 in FIG. 6), which is formed of $SiO_2$, may be placed over the anti-reflective layer 48.

Next, the resulting assembly is thermal compression bonded to a glass face plate which forms the window portion 14*c*. Preferably, the glass face plate may be made of 7056 borosilicate glass. Such a glass is available from Corning Glass. Next, the assembly described so far then has the bulk substrate 54 etched away using a suitable concentration of a conventional etchant, such as $NH_4OH$ and $H_2O_2$. The stop layer 58 is removed using Hcl solution.

Subsequently, the spacer layer 60 is patterned and etched using photoreactive masking material and etchant, to produce the rib 42. The thickness of the active layer 52 may be adjusted in two steps using suitable etchants, as is further explained below. The thickness of the active layer 52 is preferably reduced to be in the range from about 1.2 microns to as thin as about 0.45 micron. Using an etchant solution of $NH_4OH$ and $H_2O_2$, the active layer 52 may be initially thinned. Then in a second step, an etchant solution of $H_2SO_4$ and $H_2O_2$ is used to further adjust the active layer thickness so that it matches the selected thickness for this layer. Thus, it will be appreciated that the thickness of the active layer 52 may be greater immediately under the rib 42 (viewing FIG. 6 once again—and recalling that the drawings are not to scale) than it is in the active portion 44 of this active layer. For purposes of illustration, the height of rib 42*a*, for example, is shown somewhat exaggerated. The peripheral metallization electrode 46 is applied for connection of electrostatic charge from the power supply 28 to the photocathode 20 via this ring and the metallization layer.

This second etch step, as well as a definition step for the rib 42 may be conducted just before the photocathode assembly is loaded into a vacuum exhaust system in preparation for uniting this photocathode (i.e., on window portion 14*c*) with the remainder of the tube 14 so as to minimize contamination of the active layer surface in active area 44. Once the active layer 52 is thinned to the desired thickness, the rib 42 may be planarized using conventional techniques known to the semiconductor fabrication industry, to produce the end surface 42*a* on this rib at a precisely controlled spacing distance from the surface of active area 44. As will be appreciated in view of the above, the spacing of surface 42*a* from the surface of the active area 44 is essentially the gap dimension "G" explained above. This correlation of the dimension of the end surface 42*a* of the rib 42 above the surface of active area 44, and the gap dimension "G" is shown on FIG. 3.

Next, the active layer 52 is thermally surface cleaned in a very high vacuum exhaust station to remove surface oxides and absorbed gas species. The active layer 52 is next activated with Cs and $O_2$ to enhance the photosensitivity of the photocathode 20. The resulting finished photocathode assembly is then bonded to the remainder of the tube 14 by use of a cold weld effected under high vacuum, oxygen-free conditions. As this cold weld process is conducted, the rib 42 is effective to insure establishment and maintenance of a precisely controlled and fine-dimension gap "G" between the PC 20 (i.e., at the surface of active area 44) and the closest face of the MCP 22.

FIG. 8 provides a perspective view of an alternative embodiment of the present invention, which is similar to FIG. 4, except as described below. Because of the similarities of this alternative embodiment of the invention to that which has already been described, the same reference numeral used above, but increased by one-hundred (100) is used in FIG. 8 to indicate features which are the same or which are equivalent in structure or function to a feature already described above. Viewing now FIG. 8, a window portion 114*c* is seen in the same perspective position as window portion 14 of FIG. 4. However, in this alternative embodiment, the rib 142 has a crenellated configuration, with plural circumferentially spaced apart merlons 142*c* spacing apart a corresponding plurality of arcuate circumferentially extending crenels 142*b* extending between the active area 144 and the electrode 146.

The merlons 142*c* cooperatively define end surface 142*a* for the rib 142, which end surface is at a spacing from the surface of the active area 144 as was described above (i.e., to establish gap "G"). Further, the metallic electrode 146 has plural radially extending portions 146*a* which pass inwardly though the crenels 142*b* to make multiple circumferentially spaced apart electrical contacts with the active area 144. Thus, in this embodiment, the rib 142 is discontinuous circumferentially, and radially extending portions 146*a* of the electrode 146 extend through plural openings of the rib to make electrical contact directly with the active area of the PC.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. For example, the spacer structure does not have to be integral with the photocathode in order to effect the establishment and maintenance of the desired fine-dimension gap dimension. That is, the spacing structure could be carried by some other element of the structure. However, the spacing structure does extend axially between the photocathode and the input face of the microchannel plate in order to space these two structures apart. Accordingly, it is seen that the depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A method of making an image intensifier tube which includes a photocathode with an active layer and a microchannel plate, and further includes structure for establishing a fine-dimension spacing distance between the photocathode and microchannel plate, said method comprising the steps of:

providing a body for said image intensifier tube;

carrying said microchannel plate within said body;

providing a window portion for closing said body and carrying said photocathode;

providing a generally annular insulative spacing structure circumscribing said active layer and extending between said photocathode and said microchannel plate to establish and maintain said fine-dimension spacing distance.

2. The method of claim 1 further including the step of sealingly uniting said window portion with said body while advancing said photocathode toward said microchannel plate until said insulative spacing structure contacts between said photocathode and said microchannel plate to establish said spacing distance.

3. The method of claim 1 additionally including the step of configuring said insulative spacing structure as an annulus carried by said photocathode.

4. The method of claim 1 further including the step of providing electrical connection to an active area of said photocathode by conduction though an annular area of said photocathode, which annular area underlies said annular insulative spacing structure.

5. The method of claim 1 further including the step of crenellating said annular insulative spacing structure to provide plural crenels each penetrating radially through said spacing structure radially from a peripherally outer portion of the photocathode to said active area thereof.

6. The method of claim 5 further including the step of providing a metallic conductive electrode coating upon a peripheral portion of a transparent window member carrying said photocathode, and extending a part of said electrode coating through said crenels to contact said active area of said photocathode.

7. A method of making establishing and maintaining a selected fine-dimension spacing dimension between an active area of a photocathode and an electron input face of a microchannel plate, said method comprising steps of:

providing a generally annular insulative spacing structure circumscribing said active layer and extending between said photocathode and said electron input face of said microchannel plate; and utilizing said spacing structure by physical contact with at least one of said photocathode and microchannel plate to establish said selected fine-dimension spacing dimension.

8. The method of claim 7 further including the step of biasing said photocathode and microchannel plate toward one another so that said physical contact is maintained.

9. The method of claim 8 additionally including the step of configuring said insulative spacing structure as an annulus carried integrally by said photocathode.

10. The method of claim 8 further including the step of configuring said insulative spacing structure as a crenellated annulus carried by said photocathode and defining plural radially extending crenels each extending radially between said active area of the photocathode and a radially outer portion thereof.

11. The method of claim 7 further including the step of providing a metallic conductive electrode coating upon an outer peripheral portion of said photocathode and providing electrical contact with said active area of said photocathode.

* * * * *